US008647805B2

(12) United States Patent
Nosella et al.

(10) Patent No.: US 8,647,805 B2
(45) Date of Patent: Feb. 11, 2014

(54) EMULSION AGGREGATION TONERS HAVING FLOW AIDS

(75) Inventors: Kimberly D. Nosella, Mississauga (CA); Melanie Lynn Davis, Hamilton (CA); Cuong Vong, Hamilton (CA); Abdisamed Sheik-Qasim, Etobicoke (CA)

(73) Assignee: Xerox Corporation, Norwalk, CT (US)

( * ) Notice: Subject to any disclaimer, the term of this patent is extended or adjusted under 35 U.S.C. 154(b) by 248 days.

(21) Appl. No.: 12/887,801

(22) Filed: Sep. 22, 2010

(65) Prior Publication Data

US 2012/0070776 A1 Mar. 22, 2012

(51) Int. Cl.
*G03G 9/083* (2006.01)

(52) U.S. Cl.
USPC ..... 430/137.14; 430/123.51

(58) Field of Classification Search
USPC ..... 430/137.14, 123.51
See application file for complete search history.

(56) References Cited

U.S. PATENT DOCUMENTS

| | | | |
|---|---|---|---|
| 3,590,000 | A | 6/1971 | Palermiti et al. |
| 4,298,672 | A | 11/1981 | Lu |
| 4,338,390 | A | 7/1982 | Lu |
| 5,290,654 | A | 3/1994 | Sacripante et al. |
| 5,302,486 | A | 4/1994 | Patel et al. |
| 5,853,943 | A | 12/1998 | Cheng et al. |
| 5,902,710 | A | 5/1999 | Ong et al. |
| 5,910,387 | A | 6/1999 | Mychajlowskij et al. |
| 5,916,725 | A | 6/1999 | Patel et al. |
| 5,919,595 | A | 7/1999 | Mychajlowskij et al. |
| 5,925,488 | A | 7/1999 | Patel et al. |
| 5,977,210 | A | 11/1999 | Patel et al. |
| 5,994,020 | A | 11/1999 | Patel et al. |
| 6,214,507 | B1 | 4/2001 | Sokol et al. |
| 6,593,049 | B1 | 7/2003 | Veregin et al. |
| 6,756,176 | B2 | 6/2004 | Stegamat et al. |
| 6,830,860 | B2 | 12/2004 | Sacripante et al. |
| 7,238,459 | B2 | 7/2007 | Malachowski |
| 7,329,476 | B2 | 2/2008 | Sacripante et al. |
| 2006/0216626 | A1 | 9/2006 | Sacripante et al. |
| 2008/0107989 | A1 | 5/2008 | Sacripante et al. |
| 2008/0107990 | A1 | 5/2008 | Field et al. |
| 2008/0107991 | A1 * | 5/2008 | Hamano ..... 430/109.4 |
| 2008/0153027 | A1 | 6/2008 | Veregin et al. |
| 2008/0236446 | A1 | 10/2008 | Zhou et al. |
| 2009/0047593 | A1 | 2/2009 | Vanbesien et al. |
| 2010/0055598 | A1 * | 3/2010 | Zhou et al. ..... 430/109.31 |

* cited by examiner

*Primary Examiner* — Jonathan Jelsma
(74) *Attorney, Agent, or Firm* — MDIP LLC

(57) ABSTRACT

The present disclosure provides processes for producing toners. In embodiments, flow aids are added to a wet cake including the toner particles, prior to drying. The addition of the flow aid improves flow characteristics of the toner, thereby enhancing overall drying time, reducing the amount of coarse particles, and improving yield, without adversely affecting fusing and charging of the toner particles.

20 Claims, 2 Drawing Sheets

EMULSION AGGREGATION TONERS HAVING FLOW AIDS

BACKGROUND

The present disclosure relates to processes for producing toners. In embodiments, flow aids are added to improve flow characteristics of a toner, thereby enhancing overall drying time, reducing the amount of coarse particles and improving yield, without adversely affecting fusing and charging of the toner particles.

Numerous processes are within the purview of those skilled in the art for the preparation of toners. Emulsion aggregation (EA) is one such method. Emulsion aggregation toners may be used in forming print and/or electrophotographic images. Emulsion aggregation techniques may involve the formation of a polymer emulsion by heating a monomer and undertaking a batch or semi-continuous emulsion polymerization, as disclosed in, for example, U.S. Pat. No. 5,853,943, the disclosure of which is hereby incorporated by reference in its entirety. Other examples of emulsion/aggregation/coalescing processes for the preparation of toners are illustrated in U.S. Pat. Nos. 5,902,710; 5,910,387; 5,916,725; 5,919,595; 5,925,488, 5,977,210, 5,994,020, and U.S. Patent Application Publication No. 2008/0107989, the disclosures of each of which are hereby incorporated by reference in their entirety.

Polyester toners have been prepared utilizing amorphous and crystalline polyester resins as illustrated, for example, in U.S. Patent Application Publication No. 2008/0153027, the disclosure of which is hereby incorporated by reference in its entirety.

One issue with emulsion aggregation toners is that the drying process utilized to form the particles may result in the dried toner becoming compacted; this may be partly because the toner particles have strong cohesive forces. The toner may thus stick to both itself and the drying apparatus, thereby reducing the overall toner yield and higher toner unit manufacturing cost (UMC), which may thus result in lost profits. One way to minimize the compaction problem is to equip the drying apparatus with impact vibrators or some similar apparatus; however, even with these standard automated methods in place, the toner may not be easily loosened. Thus, the toner yields remain low.

It would be advantageous to provide a more efficient process for recovering emulsion aggregation toners from the apparatus utilized in their formation.

SUMMARY

The present disclosure provides processes for producing toner particles and toners produced by such processes. In embodiments, a process of the present disclosure may include contacting at least one amorphous resin with at least one crystalline resin in a mixture; aggregating the mixture to form particles; coalescing the particles to form toner particles; washing the toner particles to form a wet cake of toner particles; contacting the wet cake with at least one flow aid including a hydrophobic metal oxide; drying the wet cake; and recovering the toner particles, wherein the toner particles possess the hydrophobic metal oxide in amounts of from about 5 ppm to about 20,000 ppm.

In other embodiments, a process of the present disclosure includes contacting at least one amorphous resin with at least one crystalline resin in a mixture; aggregating the mixture to form particles; coalescing the particles to form toner particles; washing the toner particles to form a wet cake of toner particles; contacting the wet cake with at least one flow aid including a hydrophobic metal oxide including an oxide of a metal such as silicon, titanium, nickel, zirconium, silver, chromium, aluminum, cerium, zinc, strontium, beryllium, and combinations thereof; drying the wet cake; and recovering the toner particles, wherein the toner particles possess the hydrophobic metal oxide in amounts of from about 5 ppm to about 20,000 ppm.

In yet other embodiments, a process of the present disclosure includes contacting at least one amorphous resin with at least one crystalline resin in a mixture; aggregating the mixture to form particles at a temperature of from about 40° C. to about 100° C., for a time of from about 0.5 hours to about 6 hours; coalescing the particles to form toner particles at a temperature of from about 45° C. to about 100° C., over a period of time of from about 0.01 to about 9 hours; washing the toner particles to form a wet cake of toner particles; contacting the wet cake with at least one flow aid including hydrophobic silica particles having a size of from about 5 nm to about 50 nm; drying the wet cake; and recovering the toner particles, wherein the toner particles possess the hydrophobic silica in amounts of from about 5 ppm to about 20,000 ppm.

BRIEF DESCRIPTION OF DRAWINGS

Various embodiments of the present disclosure will be described herein below with reference to the figures wherein.

DETAILED DESCRIPTION

Figure 1:
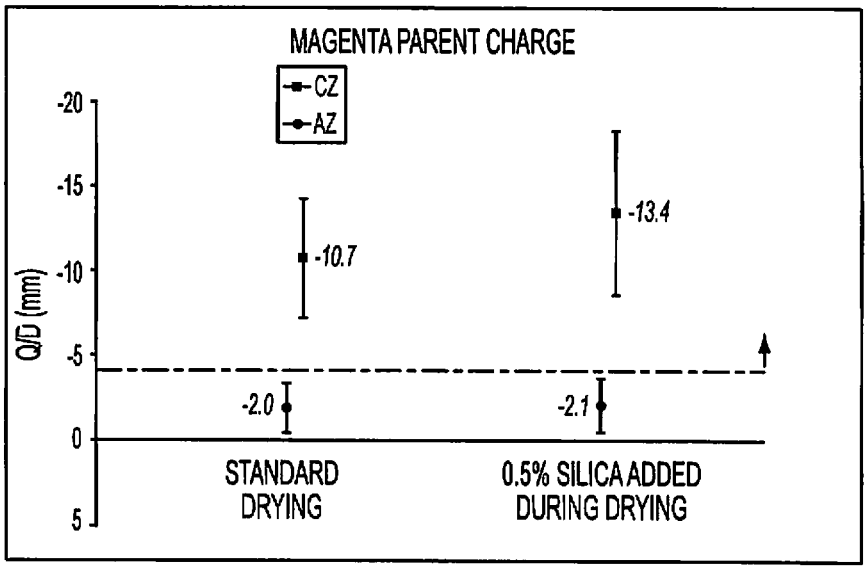
FIG. 1 is a graph depicting parent charge of a toner produced in accordance with the present disclosure, with silica added to the wet cake prior to drying, compared with the same toner lacking the silica treatment used as a control.

The present disclosure provides for the use of flow aids in a toner production process to reduce the time required to produce the toner and enhance the yield of the process, thereby improving the efficiency of the toner production process and lowering the UMC of a toner produced by such a process.

In embodiments, the processes of the present disclosure may reduce the overall drying cycle time for production of a toner with reduced coarse content of the particles produced. The overall yield is also increased. All of the above benefits may be obtained without adversely affecting fusing or charging of the resulting toner particles.

Resins

Toners of the present disclosure may include any latex resin suitable for use in forming a toner. Such resins, in turn, may be made of any suitable monomer. Suitable monomers useful in forming the resin include, but are not limited to, acrylonitriles, diols, diacids, diamines, diesters, diisocyanates, combinations thereof, and the like. Any monomer employed may be selected depending upon the particular polymer to be utilized.

The resins may be made by any suitable polymerization method. In embodiments, the resin may be prepared by emulsion polymerization. In other embodiments, the resin may be prepared by condensation polymerization.

In embodiments, the polymer utilized to form the resin may be a polyester resin. Suitable polyester resins include, for example, sulfonated, non-sulfonated, crystalline, amorphous, combinations thereof, and the like. The polyester resins may be linear, branched, combinations thereof, and the like. Polyester resins may include, in embodiments, those resins described in U.S. Pat. Nos. 6,593,049 and 6,756,176, the disclosures of each of which are hereby incorporated by reference in their entirety. Suitable resins may also include a mixture of an amorphous polyester resin and a crystalline polyester resin as described in U.S. Pat. No. 6,830,860, the disclosure of which is hereby incorporated by reference in its entirety.

The monomers used in making the selected amorphous polyester resin are not limited, and the monomers utilized may include any one or more of, for example, ethylene, propylene, and the like. Known chain transfer agents, for example dodecanethiol or carbon tetrabromide, can be utilized to control the molecular weight properties of the polyester. Any suitable method for forming the amorphous or crystalline polyester from the monomers may be used without restriction.

In embodiments, a resin utilized in forming a toner may include an amorphous polyester resin. In embodiments, the resin may be a polyester resin formed by reacting a diol with a diacid or diester in the presence of an optional catalyst.

Examples of organic diols selected for the preparation of amorphous resins include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol is, for example, selected in an amount of from about 45 to about 50 mole percent of the resin, and the alkali sulfo-aliphatic diol can be selected in an amount of from about 1 to about 10 mole percent of the resin.

Examples of diacid or diesters selected for the preparation of the amorphous polyester include dicarboxylic acids or diesters selected from the group consisting of terephthalic acid, phthalic acid, isophthalic acid, fumaric acid, maleic acid, itaconic acid, succinic acid, succinic anhydride, dodecylsuccinic acid, dodecylsuccinic anhydride, dodecenylsuccinic acid, dodecenylsuccinic anhydride, glutaric acid, glutaric anhydride, adipic acid, pimelic acid, suberic acid, azelaic acid, dodecane diacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, dimethyl dodecenylsuccinate, and mixtures thereof. The organic diacid or diester is selected, for example, from about 45 to about 52 mole percent of the resin.

Examples of suitable polycondensation catalyst for either the amorphous polyester resin include tetraalkyl titanates, dialkyltin oxide such as dibutyltin oxide, tetraalkyltin such as dibutyltin dilaurate, dialkyltin oxide hydroxide such as butyltin oxide hydroxide, aluminum alkoxides, alkyl zinc, dialkyl zinc, zinc oxide, stannous oxide, or mixtures thereof; and which catalysts are selected in amounts of, for example, from about 0.01 mole percent to about 5 mole percent based on the starting diacid or diester used to generate the polyester resin.

In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Examples of amorphous resins which may be utilized include amorphous polyester resins. Exemplary amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly (ethoxylated bisphenol co-itaconate), poly(butyloxylated bisphenol co-itaconate), poly(co-propoxylated bisphenol co-ethoxylated bisphenol co-itaconate), poly(1,2-propylene itaconate), a copoly(propoxylated bisphenol A co-fumarate)-copoly(propoxylated bisphenol A co-terephthalate), a terpoly (propoxylated bisphenol A co-fumarate)-terpoly(propoxylated bisphenol A co-terephthalate)-terpoly-(propoxylated bisphenol A co-dodecylsuccinate), and combinations thereof. In embodiments, the amorphous resin utilized in the core may be linear.

In embodiments, a suitable amorphous resin may include alkoxylated bisphenol A fumarate/terephthalate based polyesters and copolyester resins. In embodiments, a suitable amorphous polyester resin may be a copoly(propoxylated bisphenol A co-fumarate)-copoly(propoxylated bisphenol A co-terephthalate) resin having the following formula (I):

(I)

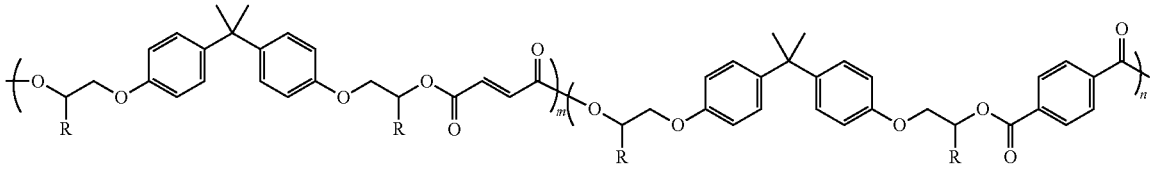

wherein R may be hydrogen or a methyl group, and m and n represent random units of the copolymer and m may be from about 2 to 10, and n may be from about 2 to 10.

An example of a linear copoly(propoxylated bisphenol A co-fumarate)-copoly(propoxylated bisphenol A co-terephthalate) which may be utilized as a latex resin is available under the trade name SPARE from Resana SIA Industrias Quimicas, Sao Paulo Brazil. Other propoxylated bisphenol A fumarate resins that may be utilized and are commercially available include GTUF and FPESL-2 from Kao Corporation, Japan, and EM181635 from Reichhold, Research Triangle Park, North Carolina and the like.

In embodiments, the amorphous polyester resin may be a saturated or unsaturated amorphous polyester resin. Illustrative examples of saturated and unsaturated amorphous polyester resins selected for the process and particles of the present disclosure include any of the various amorphous polyesters, such as polyethylene-terephthalate, polypropylene-terephthalate, polybutylene-terephthalate, polypentylene-terephthalate, polyhexalene-terephthalate, polyheptadene-terephthalate, polyoctalene-terephthalate, polyethylene-isophthalate, polypropylene-isophthalate, polybutylene-isophthalate, polypentylene-isophthalate, polyhexalene-isophthalate, polyheptadene-isophthalate, polyoctalene-isophthalate, polyethylene-sebacate, polypropylene sebacate, polybutylene-sebacate, polyethylene-adipate, polypropylene-adipate, polybutylene-adipate, polypentylene-adipate, polyhexalene-adipate, polyheptadene-adipate, polyoctalene-adipate, polyethylene-glutarate, polypropylene-glutarate, polybutylene-glutarate, polypentylene-glutarate, polyhexalene-glutarate, polyheptadene-glutarate, polyoctalene-glutarate polyethylene-pimelate, polypropylene-pimelate, polybutylene-pimelate, polypentylene-pimelate, polyhexalene-pimelate, polyheptadene-pimelate, poly(ethoxylated bisphenol A-fumarate), poly(ethoxylated bisphenol A-succinate), poly(ethoxylated bisphenol A-adipate), poly(ethoxylated bisphenol A-glutarate), poly (ethoxylated bisphenol A-terephthalate), poly(ethoxylated bisphenol A-isophthalate), poly(ethoxylated bisphenol A-dodecenylsuccinate), poly(propoxylated bisphenol A-fumarate), poly(propoxylated bisphenol A-succinate), poly (propoxylated bisphenol A-adipate), poly(propoxylated bisphenol A-glutarate), poly(propoxylated bisphenol A-terephthalate), poly(propoxylated bisphenol A-isophthalate), poly(propoxylated bisphenol A-dodecenylsuccinate), SPAR (Dixie Chemicals), BECKOSOL (Reichhold Inc), ARAKOTE (Ciba-Geigy Corporation), HETRON (Ashland Chemical), PARAPLEX (Rohm & Haas), POLYLITE (Reichhold Inc), PLASTHALL (Rohm & Haas), CYGAL (American Cyanamide), ARMCO (Armco Composites), ARPOL (Ashland Chemical), CELANEX (Celanese Eng), RYNITE (DuPont), STYPOL (Freeman Chemical Corporation) and combinations thereof. The resins can also be functionalized, such as carboxylated, sulfonated, or the like, and particularly such as sodio sulfonated, if desired.

The amorphous polyester resin may be a branched resin. As used herein, the terms "branched" or "branching" includes branched resin and/or cross-linked resins. Branching agents for use in forming these branched resins include, for example, a multivalent polyacid such as 1,2,4-benzene-tricarboxylic acid, 1,2,4-cyclohexanetricarboxylic acid, 2,5,7-naphthalenetricarboxylic acid, 1,2,4-naphthaleneticarboxylic acid, 1,2,5-hexanetricarboxylic acid, 1,3-dicarboxyl-2-methyl-2-methylene-carboxylpropane, tetra(methylene-carboxyl) methane, and 1,2,7,8-octanetetracarboxylic acid, acid anhydrides thereof, and lower alkyl esters thereof, 1 to about 6 carbon atoms; a multivalent polyol such as sorbitol, 1,2,3,6-hexanetetrol, 1,4-sorbitane, pentaerythritol, dipentaerythritol, tripentaerythritol, sucrose, 1,2,4-butanetriol, 1,2,5-pentatriol, glycerol, 2-methylpropanetriol, 2-methyl-1,2,4-butanetriol, trimethylolethane, trimethylolpropane, 1,3,5-trihydroxymethylbenzene, mixtures thereof, and the like. The branching agent amount selected is, for example, from about 0.1 to about 5 mole percent of the resin.

Linear or branched unsaturated polyesters selected for reactions include both saturated and unsaturated diacids (or anhydrides) and dihydric alcohols (glycols or diols). The resulting unsaturated polyesters are reactive (for example, crosslinkable) on two fronts: (i) unsaturation sites (double bonds) along the polyester chain, and (ii) functional groups such as carboxyl, hydroxy, and the like groups amenable to acid-base reactions. Typical unsaturated polyester resins may be prepared by melt polycondensation or other polymerization processes using diacids and/or anhydrides and diols.

In embodiments, a suitable amorphous resin utilized in a toner of the present disclosure may be a low molecular weight amorphous resin, sometimes referred to, in embodiments, as an oligomer, having a weight average molecular weight (Mw) of from about 500 daltons to about 10,000 daltons, in embodiments from about 1000 daltons to about 5000 daltons, in other embodiments from about 1500 daltons to about 4000 daltons.

The low molecular weight amorphous resin may possess a glass transition temperature (Tg) of from about 60° C. to about 70° C., in embodiments from about 62° C. to about 64° C. These low molecular weight amorphous resins may be referred to, in embodiments, as a high Tg amorphous resin.

The low molecular weight amorphous resin may possess a softening point of from about 105° C. to about 118° C., in embodiments from about 107° C. to about 109° C.

In other embodiments, an amorphous resin utilized in forming a toner of the present disclosure may be a high molecular weight amorphous resin. As used herein, the high molecular weight amorphous polyester resin may have, for example, a number average molecular weight ($M_n$), as measured by gel permeation chromatography (GPC) of, for example, from about 1,000 to about 10,000, in embodiments from about 2,000 to about 9,000, in embodiments from about 3,000 to about 8,000, and in embodiments from about 6,000 to about 7,000. The weight average molecular weight ($M_w$) of the resin is greater than 45,000, for example, from about 45,000 to about 150,000, in embodiments from about 50,000 to about 100,000, in embodiments from about 63,000 to about 94,000, and in embodiments from about 68,000 to about 85,000, as determined by GPC using polystyrene standard. The polydispersity index (PD) is above about 4, such as, for example, greater than about 4, in embodiments from about 4 to about 20, in embodiments from about 5 to about 10, and in embodiments from about 6 to about 8, as measured by GPC versus standard polystyrene reference resins. The PD index is the ratio of the weight-average molecular weight ($M_w$) and the number-average molecular weight ($M_n$). The low molecular weight amorphous polyester resins may have an acid value of from about 8 to about 20 mg KOH/g, in embodiments from about 9 to about 16 mg KOH/g, and in embodiments from about 11 to about 15 mg KOH/g. The high molecular weight amorphous polyester resins, which are available from a number of sources, can possess various melting points of, for example, from about 30° C. to about 140° C., in embodiments from about 75° C. to about 130° C., in embodiments from about 100° C. to about 125° C., and in embodiments from about 115° C. to about 124° C.

High molecular weight amorphous resins may possess a glass transition temperature of from about 53° C. to about 59° C., in embodiments from about 54.5° C. to about 57° C. These high molecular weight amorphous resins may be referred to, in embodiments, as a low Tg amorphous resin.

In embodiments, a combination of low Tg and high Tg amorphous resins may be used to form a toner of the present disclosure. The ratio of low Tg amorphous resin to high Tg amorphous resin may be from about 0:100 to about 100:0, in embodiments from about 30:70 to about 50:50. In embodiments, the combined amorphous resins may have a melt viscosity of from about 10 to about 1,000,000 Pa*S at about 130° C., in embodiments from about 50 to about 100,000 Pa*S.

The amorphous resin is generally present in the toner composition in various suitable amounts, such as from about 60 to about 90 weight percent, in embodiments from about 50 to about 65 weight percent, of the toner or of the solids.

In embodiments, the toner composition may include at least one crystalline resin. As used herein, "crystalline" refers to a polyester with a three dimensional order. "Semicrystalline resins" as used herein refers to resins with a crystalline percentage of, for example, from about 10 to about 90%, in embodiments from about 12 to about 70%. Further, as used herein, "crystalline polyester resins" and "crystalline resins" encompass both crystalline resins and semicrystalline resins, unless otherwise specified.

In embodiments, the crystalline polyester resin is a saturated crystalline polyester resin or an unsaturated crystalline polyester resin.

For forming a crystalline polyester, suitable organic diols include aliphatic diols having from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, ethylene glycol, combinations thereof, and the like. The aliphatic diol may be, for example, selected in an amount of from about 40 to about 60 mole percent, in embodiments from about 42 to about 55 mole percent, in embodiments from about 45 to about 53 mole percent of the resin.

Examples of organic diacids or diesters selected for the preparation of the crystalline resins include oxalic acid, succinic acid, glutaric acid, adipic acid, suberic acid, azelaic acid, fumaric acid, maleic acid, dodecanedioic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof, and combinations thereof. The organic diacid may be selected in an amount of, for example, in embodiments from about 40 to about 60 mole percent, in embodiments from about 42 to about 55 mole percent, in embodiments from about 45 to about 53 mole percent.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), polypropylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), alkali copoly(5-sulfoisophthaloyl)-copoly(ethylene-adipate), poly(decylene-sebacate), poly(decylene-decanoate), poly-(ethylene-decanoate), poly-(ethylene-dodecanoate), poly(nonylene-sebacate), poly (nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), and combinations thereof. The crystalline resin may be present, for example, in an amount of from about 5 to about 50 percent by weight of the toner components, in embodiments from about 10 to about 35 percent by weight of the toner components.

The crystalline polyester resins, which are available from a number of sources, may possess various melting points of, for example, from about 30° C. to about 120° C., in embodiments from about 50° C. to about 90° C. The crystalline resins may have, for example, a number average molecular weight ($M_n$), as measured by gel permeation chromatography (GPC) of, for example, from about 1,000 to about 50,000, in embodiments from about 2,000 to about 25,000, in embodiments from about 3,000 to about 15,000, and in embodiments from about 6,000 to about 12,000. The weight average molecular weight ($M_W$) of the resin is 50,000 or less, for example, from about 2,000 to about 50,000, in embodiments from about 3,000 to about 40,000, in embodiments from about 10,000 to about 30,000 and in embodiments from about 21,000 to about 24,000, as determined by GPC using polystyrene standards. The molecular weight distribution ($M_w/M_n$) of the crystalline resin is, for example, from about 2 to about 6, in embodiments from about 3 to about 4. The crystalline polyester resins may have an acid value of about 2 to about 20 mg KOH/g, in embodiments from about 5 to about 15 mg KOH/g, and in embodiments from about 8 to about 13 mg KOH/g. The acid value (or neutralization number) is the mass of potassium hydroxide (KOH) in milligrams that is required to neutralize one gram of the crystalline polyester resin.

Suitable crystalline polyester resins include those disclosed in U.S. Pat. No. 7,329,476 and U.S. Patent Application Publication Nos. 2006/0216626, 2008/0107990, 2008/0236446 and 2009/0047593, each of which is hereby incorporated by reference in their entirety. In embodiments, a suitable crystalline resin may include a resin composed of ethylene glycol or nonanediol and a mixture of dodecanedioic acid and fumaric acid co-monomers with the following formula (II):

(II)

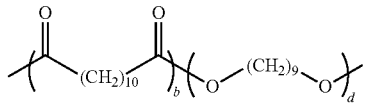

wherein b is from about 5 to about 2000 and d is from about 5 to about 2000.

If semicrystalline polyester resins are employed herein, the semicrystalline resin may include poly(3-methyl-1-butene), poly(hexamethylene carbonate), poly(ethylene-p-carboxy phenoxy-butyrate), poly(ethylene-vinyl acetate), poly(docosyl acrylate), poly(dodecyl acrylate), poly(octadecyl acrylate), poly(octadecyl methacrylate), poly(behenylpolyethoxyethyl methacrylate), poly(ethylene adipate), poly (decamethylene adipate), poly(decamethylene azelaate), poly(hexamethylene oxalate), poly(decamethylene oxalate), poly(ethylene oxide), poly(propylene oxide), poly(butadiene oxide), poly(decamethylene oxide), poly(decamethylene sulfide), poly(decamethylene disulfide), poly(ethylene sebacate), poly(decamethylene sebacate), poly(ethylene suberate), poly(decamethylene succinate), poly(eicosamethylene malonate), poly(ethylene-p-carboxy phenoxy-undecanoate), poly(ethylene dithionesophthalate), poly(methyl ethylene terephthalate), poly(ethylene-p-carboxy phenoxy-valerate), poly(hexamethylene-4,4'-oxydibenzoate), poly(10-hydroxy capric acid), poly(isophthalaldehyde), poly(octamethylene dodecanedioate), poly(dimethyl siloxane), poly(dipropyl siloxane), poly(tetramethylene phenylene diacetate), poly (tetramethylene trithiodicarboxylate), poly(trimethylene dodecane dioate), poly(m-xylene), poly(p-xylylene pimelamide), and combinations thereof.

A crystalline polyester resin in a toner particle of the present disclosure may be present in an amount of from about 1 to about 15 percent by weight, in embodiments from about 5 to about 10 percent by weight, and in embodiments from about 6 to about 8 percent by weight, of the toner particles (that is, toner particles exclusive of external additives and water).

As noted above, in embodiments a toner of the present disclosure may also include at least one high molecular weight branched or cross-linked amorphous polyester resin. This high molecular weight resin may include, in embodiments, for example, a branched amorphous resin or amorphous polyester, a cross-linked amorphous resin or amorphous polyester, or mixtures thereof, or a non-cross-linked amorphous polyester resin that has been subjected to cross-linking. In accordance with the present disclosure, from about 1% by weight to about 100% by weight of the high molecular weight amorphous polyester resin may be branched or cross-linked, in embodiments from about 2% by weight to about 50% by weight of the higher molecular weight amorphous polyester resin may be branched or cross-linked.

In embodiments, toner particles of the present disclosure may have a core including from about 8% by weight to about 15% by weight of a low molecular weight, high Tg, amorphous resin, in embodiments from about 9% by weight to about 12% by weight of a low molecular weight, high Tg, amorphous resin, in embodiments about 10.85% by weight of a low molecular weight, high Tg, resin, in combination with from about 36% by weight to about 44% by weight of a high molecular weight, low Tg, amorphous resin, in embodiments from about 37% by weight to about 43% by weight of a high molecular weight, low Tg, amorphous resin, in embodiments about 38.85% by weight of a high molecular weight, low Tg, resin. Such toner particles may also include a shell including from about 25% by weight to about 55% by weight of a low molecular weight, high Tg, amorphous resin, in embodiments from about 26% by weight to about 35% by weight of a low molecular weight, high Tg, amorphous resin, in embodiments about 28% by weight of the low molecular weight, high Tg, resin, optionally in combination with from about 25% by weight to about 55% by weight of a high molecular weight, low Tg, amorphous resin, in embodiments from about 27% by weight to about 40% by weight of a high molecular weight, low Tg, amorphous resin, in embodiments from about 30% by weight to about 35% by weight of a high molecular weight, low Tg, amorphous resin.

As noted above, in embodiments, the resin may be formed by emulsion aggregation methods. Utilizing such methods, the resin may be present in a resin emulsion, which may then be combined with other components and additives to form a toner of the present disclosure.

Surfactants

In embodiments, the process of the present disclosure may optionally include adding a surfactant, before or during the melt mixing, to the resin at an elevated temperature. In embodiments, the surfactant may be added prior to melt-mixing the resin at an elevated temperature.

Where utilized, a resin emulsion may include one, two, or more surfactants. The surfactants may be selected from ionic surfactants and nonionic surfactants. Anionic surfactants and cationic surfactants are encompassed by the term "ionic surfactants." In embodiments, the surfactant may be added as a solid or as a solution with a concentration of from about 5% to about 100% (pure surfactant) by weight, in embodiments, from about 10% to about 95% by weight. In embodiments, the surfactant may be utilized so that it is present in an amount of from about 0.01% to about 20% by weight of the resin, in embodiments, from about 0.1% to about 16% by weight of the resin, in other embodiments, from about 1% to about 14% by weight of the resin.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecylbenzene sulfonates. Combinations of these surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

Examples of nonionic surfactants that may be utilized for the processes illustrated herein include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly (ethyleneoxy) ethanol, available from Rhone-Poulenc as IGEPAL CA-210™, IGEPAL CA-520™, IGEPAL CA720™, IGEPAL CO-890™, IGEPAL CO720™, IGEPAL CO290™, IGEPAL CA-210™, ANTAROX 890™ and ANTAROX 897™. Other examples of suitable nonionic surfactants may include a block copolymer of polyethylene oxide and polypropylene oxide, including those commercially available as SYNPERONIC PE/F, in embodiments SYNPERONIC PE/F 108. Combinations of these surfactants and any of the foregoing surfactants may be utilized in embodiments.

Toner

The resin described above may be utilized to form toner compositions. Such toner compositions may include optional colorants, waxes, and other additives. Toners may be formed utilizing any method within the purview of those skilled in the art.

Colorants

As the optional colorant to be added, various known suitable colorants, such as dyes, pigments, mixtures of dyes, mixtures of pigments, mixtures of dyes and pigments, and the like, may be included in the toner. The colorant may be included in the toner in an amount of, for example, about 0.1 to about 35 percent by weight of the toner, or from about 1 to about 15 weight percent of the toner, or from about 3 to about 10 percent by weight of the toner.

As examples of suitable colorants, mention may be made of carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Generally, cyan, magenta, or yellow pigments or dyes, or mixtures thereof, are used. The pigment or pigments are generally used as water based pigment dispersions.

Specific examples of pigments include SUNSPERSE 6000, FLEXIVERSE and AQUATONE water based pigment dispersions from SUN Chemicals, HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, Pigment Blue 15:3, and Anthrathrene Blue, identified in the Color Index as CI 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing, and the like.

Wax

Optionally, a wax may also be combined with the resin and optional colorant in forming toner particles. When included, the wax may be present in an amount of, for example, from about 1 weight percent to about 25 weight percent of the toner particles, in embodiments from about 5 weight percent to about 20 weight percent of the toner particles.

Waxes that may be selected include waxes having, for example, a weight average molecular weight of from about 500 to about 20,000, in embodiments from about 1,000 to about 10,000. Waxes that may be used include, for example, polyolefins such as polyethylene, polypropylene, and polybutene waxes such as commercially available from Allied Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550P™, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax, and Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents.

Surfactants

In embodiments, colorants, waxes, and other additives utilized to form toner compositions may be in dispersions including surfactants. Moreover, toner particles may be formed by emulsion aggregation methods where the resin and other components of the toner are placed in one or more surfactants, an emulsion is formed, toner particles are aggregated, coalesced, optionally washed and dried, and recovered.

One, two, or more surfactants may be utilized. The surfactants may be selected from ionic surfactants and nonionic surfactants. Anionic surfactants and cationic surfactants are encompassed by the term "ionic surfactants." In embodiments, the surfactant may be utilized so that it is present in an amount of from about 0.01% to about 5% by weight of the toner composition, for example from about 0.75% to about 4% by weight of the toner composition, in embodiments from about 1% to about 3% by weight of the toner composition.

Examples of nonionic surfactants that can be utilized include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenc as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. Other examples of suitable nonionic surfactants include a block copolymer of polyethylene oxide and polypropylene oxide, including those commercially available as SYNPERONIC PE/F, in embodiments SYNPERONIC PE/F 108.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN RK™, and/or NEOGEN SC™ obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

Toner Preparation

The toner particles may be prepared by any method within the purview of one skilled in the art. Although embodiments relating to toner particle production are described below with respect to emulsion aggregation processes, any suitable method of preparing toner particles may be used, including chemical processes, such as suspension and encapsulation processes disclosed in U.S. Pat. Nos. 5,290,654 and 5,302,486, the disclosures of each of which are hereby incorporated by reference in their entirety. In embodiments, toner compositions and toner particles may be prepared by aggregation and coalescence processes in which small-size resin particles are aggregated to the appropriate toner particle size and then coalesced to achieve the final toner particle shape and morphology.

In embodiments, toner compositions may be prepared by emulsion aggregation processes, such as a process that includes aggregating a mixture of an optional colorant, an optional wax and any other desired or required additives, and emulsions including the resins described above, optionally in surfactants as described above, and then coalescing the aggregate mixture. A mixture may be prepared by adding a colorant and optionally a wax or other materials, which may also be optionally in a dispersion(s) including a surfactant, to the emulsion, which may be a mixture of two or more emulsions containing the resin. The pH of the resulting mixture may be adjusted by an acid such as, for example, acetic acid, nitric acid or the like. In embodiments, the pH of the mixture may be adjusted to from about 2 to about 5. Additionally, in embodiments, the mixture may be homogenized. If the mixture is homogenized, homogenization may be accomplished by mixing at about 600 to about 6,000 revolutions per minute. Homogenization may be accomplished by any suitable means, including, for example, an IKA ULTRA TURRAX T50 probe homogenizer.

Following the preparation of the above mixture, an aggregating agent may be added to the mixture. Any suitable aggregating agent may be utilized to form a toner. Suitable aggregating agents include, for example, aqueous solutions of a divalent cation or a multivalent cation material. The aggregating agent may be, for example, an inorganic cationic aggregating agent such as polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the glass transition temperature (Tg) of the resin.

Suitable examples of organic cationic aggregating agents include, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, combinations thereof, and the like.

Other suitable aggregating agents also include, but are not limited to, tetraalkyl titinates, dialkyltin oxide, tetraalkyltin oxide hydroxide, dialkyltin oxide hydroxide, aluminum alkoxides, alkyl zinc, dialkyl zinc, zinc oxides, stannous oxide, dibutyltin oxide, dibutyltin oxide hydroxide, tetraalkyl tin, combinations thereof, and the like. Where the aggregating agent is a polyion aggregating agent, the agent may have any desired number of polyion atoms present. For example, in embodiments, suitable polyaluminum compounds have from about 2 to about 13, in other embodiments, from about 3 to about 8, aluminum ions present in the compound.

The aggregating agent may be added to the mixture utilized to form a toner in an amount of, for example, from about 0% to about 10% by weight of the resin in the mixture, in embodiments from about 0.2% to about 8% by weight of the resin in the mixture, in other embodiments from about 0.5% to about 5% by weight of the resin in the mixture. This should provide a sufficient amount of agent for aggregation.

The particles may be permitted to aggregate until a predetermined desired particle size is obtained. A predetermined desired size refers to the desired particle size to be obtained as determined prior to formation, and the particle size being monitored during the growth process until such particle size is reached. Samples may be taken during the growth process and analyzed, for example with a Coulter Counter, for average particle size. The aggregation thus may proceed by maintaining the elevated temperature, or slowly raising the temperature to, for example, from about 40° C. to about 100° C., and holding the mixture at this temperature for a time of from about 0.5 hours to about 6 hours, in embodiments from about hour 1 to about 5 hours, while maintaining stirring, to provide the aggregated particles. Once the predetermined desired particle size is reached, then the growth process is halted.

The growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example of from about 40° C. to about 90° C., in embodiments from about 45° C. to about 80° C., which may be below the glass transition temperature of the resin as discussed above.

Once the desired final size of the toner particles is achieved, the pH of the mixture may be adjusted with a base to a value of from about 3 to about 10, and in embodiments from about 5 to about 9. The adjustment of the pH may be utilized to freeze, that is to stop, toner growth. The base utilized to stop toner growth may include any suitable base such as, for example, alkali metal hydroxides such as, for example, sodium hydroxide, potassium hydroxide, ammonium hydroxide, combinations thereof, and the like. In embodiments, ethylene diamine tetraacetic acid (EDTA) may be added to help adjust the pH to the desired values noted above.

In embodiments, the final size of the toner particles may be of from about 2 μm to about 12 μm, in embodiments of from about 3 μm to about 10 μm.

Shell Resin

In embodiments, after aggregation, but prior to coalescence, a resin coating may be applied to the aggregated particles to form a shell thereover. In embodiments, the core may thus include a crystalline resin, as described above. Any resin described above may be utilized as the shell. In embodiments, a polyester amorphous resin latex as described above may be included in the shell. In embodiments, the polyester amorphous resin latex described above may be combined with a different resin, and then added to the particles as a resin coating to form a shell.

In embodiments, resins which may be utilized to form a shell include, but are not limited to, a crystalline resin latex described above, and/or the amorphous resins described above. In embodiments, an amorphous resin which may be utilized to form a shell in accordance with the present disclosure includes an amorphous polyester, optionally in combination with a crystalline polyester resin latex described above. Multiple resins may be utilized in any suitable amounts. In embodiments, a first amorphous polyester resin, for example an amorphous resin of formula I above, may be present in an amount of from about 20 percent by weight to about 100 percent by weight of the total shell resin, in embodiments from about 30 percent by weight to about 90 percent by weight of the total shell resin. Thus, in embodiments, a second resin may be present in the shell resin in an amount of from about 0 percent by weight to about 80 percent by weight of the total shell resin, in embodiments from about 10 percent by weight to about 70 percent by weight of the shell resin.

The shell resin may be applied to the aggregated particles by any method within the purview of those skilled in the art. In embodiments, the resins utilized to form the shell may be in an emulsion including any surfactant described above. The emulsion possessing the resins, optionally the solvent based crystalline polyester resin latex neutralized with NaOH described above, may be combined with the aggregated particles described above so that the shell forms over the aggregated particles.

The formation of the shell over the aggregated particles may occur while heating to a temperature of from about 30° C. to about 80° C., in embodiments from about 35° C. to about 70° C. The formation of the shell may take place for a period of time of from about 5 minutes to about 10 hours, in embodiments from about 10 minutes to about 5 hours.

The shell may be present in an amount of from about 1 percent by weight to about 80 percent by weight of the latex particles, in embodiments of from about 10 percent by weight to about 40 percent by weight of the latex particles, in still further embodiments from about 20 percent by weight to about 35 percent by weight of the latex particles.

Coalescence

Following aggregation to the desired particle size and application of any optional shell, the particles may then be coalesced to the desired final shape, the coalescence being achieved by, for example, heating the mixture to a temperature of from about 45° C. to about 100° C., in embodiments from about 55° C. to about 99° C., which may be at or above the glass transition temperature of the resins utilized to form the toner particles, and/or reducing the stirring, for example to from about 1000 rpm to about 100 rpm, in embodiments from about 800 rpm to about 200 rpm. Coalescence may be accomplished over a period of from about 0.01 to about 9 hours, in embodiments from about 0.1 to about 4 hours.

Flow Aids

After aggregation and/or coalescence, the mixture may be cooled to room temperature, such as from about 20° C. to about 25° C. The cooling may be rapid or slow, as desired. A suitable cooling method may include introducing cold water to a jacket around the reactor. After cooling, the toner particles may be optionally washed with water, and then dried. Drying may be accomplished by any suitable method for drying including, for example, freeze-drying, a flash drying system known as an Aljet Thermajet dryer Model 4, commercially available from Fluid Energy Processing and Equipment company, combinations thereof, and the like.

In embodiments where the toner particles have been washed, a flow aid is added to the wet toner particles, sometimes referred to as a wet cake, prior to drying. In embodiments, suitable flow aids that may be added to the wet cake include hydrophobic metal oxides, including metal oxides of silicon, titanium, nickel, zirconium, silver, chromium, aluminum, cerium, zinc, strontium, beryllium, and combinations thereof. The particle size of the hydrophobic metal oxide may be less than about 100 nm, in embodiments from about 5 nm to about 50 nm, in embodiments from about 20 nm to about 30 nm. The hydrophobic metal oxide may be added to the wet cake in amounts of from about 0.01% to about 5%, in embodiments from about 0.1% to about 2%, in embodiments from about 0.2% to about 1%. The hydrophobic metal oxides may include nano size amorphous particles that also have important functions during printing, such as enabling development, and transfer of toner to the substrate.

In embodiments, suitable hydrophobic silicas include a silica with low amounts of free polydimethylsiloxane (PDMS) by weight, such as H05TD, commercially available from Wacker.

Such a PDMS treated silica may be present in an amount of from about 0.5% by weight to about 3% by weight of the toner, in embodiments from about 0.8% by weight to about 2.7% by weight of the toner The above silica, with low levels of free PDMS, may be combined, in embodiments, with a titanium dioxide that has been treated with fluorine. Such fluorine surface treatments include, for example, a polymer containing fluorine atoms, a surfactant containing fluorine atoms, and/or a silane containing fluorine atoms. Examples of titanium dioxide that has been treated with fluorine that may be utilized include STT100H-F10 and STT100H-F20, which are commercially available from Titan Kogyo. Fluorinated titanium dioxide may possess fluorine in amounts of from about 1% by weight of the titanium dioxide to about 20% by weight of the titanium dioxide, in embodiments from about 2% by weight of the titanium dioxide to about 10% by weight of the titanium dioxide.

The coating on the titanium dioxide may include fluoropolymers, such as polyvinylidene fluoride resins, terpolymers of styrene, methyl methacrylate, and/or silanes, such as triethoxy silane, tetrafluoroethylenes, other coatings within the purview of those skilled in the art, and the like.

Other suitable hydrophobic silicas for addition to the wet cake include those commercially available as Cabot TS-530 colloidal silica, having a particle size less than about 10 nm (from Cabot Corporation).

It has surprisingly been found that the addition of the hydrophobic metal oxide, in embodiments a silica, in the toner wet cake after washing can reduce the overall drying cycle time, so that the drying time is from about 1 minute to about 2 hours, in embodiments from about 20 minutes to about 1.75 hours, in embodiments about 1.5 hours, which corresponds to a reduction in time of from about 5% to about 35%, in embodiments from about 10% to about 30%, in embodiments about 20%, compared with the drying required in the absence of the hydrophobic metal oxide.

It has also been found that the addition of the hydrophobic metal oxide, in embodiments a silica, will reduce the amount of coarse particles obtained (>25 μm), so that the amount of coarse particles will only be from about 0.1% to about 5% by number of the total number of toner particles, in embodiments from about 0.15% to about 2% by number of the total number of toner particles.

It has also been found that the overall yield of toner particles, in embodiments in a 20 gallon batch, is increased so that the yield is from about 10.5 kg to about 12 kg, in embodiments from about 10.8 kg to about 11.5 kg, in embodiments about 11 kg, which corresponds to an increase in yield from about 5% to about 50%, in embodiments from about 10% to about 40%, in embodiments about 20%, compared with the yield obtained in the absence of the hydrophobic metal oxide.

It was also found that the cohesion (measurement of flow) of the parent toner improved with the addition of the hydrophobic metal oxide, in embodiments a silica, where 2 grams of the toner at room temperature were screened through 53 micron (A), 45 micron (B) and 38 micron (C) sieves, respectively, with a vibrational amplitude of about 1 mm for about 90 seconds. The toner remaining on the three sieves were used to calculate cohesion using the following formulation:

$$\%\ \text{Cohesion (Flow)}=50*A+30*B+10*C$$

This procedure can be done with either parent toner particles or additive blended toner particles.

Blocking or Heat Cohesion measurements were performed by sieving toner (with additives) through a 106 micron sieve, then placing about 5 grams of the sieved toner in a conditioning oven at about 45° C., and about 50% relative humidity (RH), for about 17 hours. The sample was cooled for about 30 minutes prior to measuring. The sample was then screened using Hosokawa flow tester using a 1000 micron (A) and 106 micron (B) sieves with a vibrational amplitude of about 1 mm for about 90 seconds, where the blocking or Heat Cohesion was calculated using the following formula:

$$\%\ \text{heat cohesion}=100*(A+B)/m \quad \text{(IV)}$$

where m was the exact weight of toner conditioned.

The cohesion, sometimes referred to herein, in embodiments, as flow, of a toner treated with hydrophobic metal oxide, in embodiments a silica, in accordance with the present disclosure may be from about 0% to about 20%, in embodiments from about 5% to about 10%. This may be an improvement from about 50% to about 100%, in embodiments from about 60% to about 90%, compared with the cohesion for toners produced without the hydrophobic metal oxide. While not wishing to be bound by any theory, this could be because the hydrophobicity of the parent toner is increased with the addition of the hydrophobic additive, so that water adsorption is reduced at the earliest possible stage.

All of the above benefits may be obtained without adversely affecting fusing or charging characteristics of the resulting toner particles.

Toner particles produced in accordance with the present disclosure may possess the hydrophobic metal oxide, in embodiments a silica, in amounts of from about 5 parts per million (ppm) to about 20,000 ppm, in embodiments from about 50 ppm to about 5000 ppm, in embodiments from about 100 ppm to about 3000 ppm.

Other Additives

In embodiments, the toner particles may also contain other optional additives, as desired or required. For example, the toner may include positive or negative charge control agents, for example in an amount of from about 0.1 to about 10% by weight of the toner, in embodiments from about 1 to about 3% by weight of the toner. Examples of suitable charge control agents include quaternary ammonium compounds inclusive of alkyl pyridinium halides; bisulfates; alkyl pyridinium compounds, including those disclosed in U.S. Pat. No. 4,298,672, the disclosure of which is hereby incorporated by reference in its entirety; organic sulfate and sulfonate compositions, including those disclosed in U.S. Pat. No. 4,338,390, the disclosure of which is hereby incorporated by reference in its entirety; cetyl pyridinium tetrafluoroborates; distearyl dimethyl ammonium methyl sulfate; aluminum salts such as BONTRON E84™ or E88™ (Orient Chemical Industries, Ltd.); combinations thereof, and the like.

Additional flow aid additives may be blended with the recovered toner particles after drying as described above. These additional flow aid additives may thus be present on the surface of the toner particles. Examples of these additives include metal oxides such as titanium oxide, silicon oxide, aluminum oxides, cerium oxides, tin oxide, mixtures thereof, and the like; colloidal and amorphous silicas, such as AEROSIL®, metal salts and metal salts of fatty acids inclusive of zinc stearate, calcium stearate, or long chain alcohols such as UNILIN 700, and combinations thereof.

In general, silica may be applied to the toner surface for toner flow, triboelectric charge enhancement, admix control, improved development and transfer stability, and higher toner blocking temperature. $TiO_2$ may be applied for improved relative humidity (RH) stability, triboelectric charge control and improved development and transfer stability. Zinc stearate, calcium stearate and/or magnesium stearate may optionally also be used as an external additive for providing lubricating properties, developer conductivity, triboelectric charge enhancement, enabling higher toner charge and charge stability by increasing the number of contacts between toner and carrier particles. In embodiments, a commercially available zinc stearate known as Zinc Stearate L, obtained from Ferro Corporation, may be used. The external surface additives may be used with or without a coating.

Each of these external additives may be present in an amount of from about 0.1% by weight to about 5% by weight of the toner, in embodiments of from about 0.25% by weight to about 3% by weight of the toner. In embodiments, the toners may include, for example, from about 0.1% by weight to about 5% by weight titania, from about 0.1% by weight to about 8% by weight silica, and from about 0.1% by weight to about 4% by weight zinc stearate.

Suitable additives include those disclosed in U.S. Pat. Nos. 3,590,000, and 6,214,507, the disclosures of each of which are hereby incorporated by reference in their entirety.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 25° C.

EXAMPLES

Example 1

A 20 gallon batch of a magenta emulsion aggregation toner was made as follows. A toner slurry was utilized which included about 11.6 kg of two amorphous polyester resin emulsions (at a ratio of about 50:50). One emulsion included a low molecular weight resin including an alkoxylated bisphenol A with terephthalic acid, fumaric acid, and dodecenylsuccinic acid co-monomers, and the other emulsion included a high molecular weight resin including alkoxylated bisphenol A with terephthalic acid, trimellitic acid, and dodecenylsuccinic acid co-monomers. Added thereto was about 2.1 kg of a crystalline resin emulsion of the following formula:

(II)

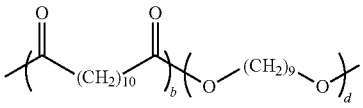

wherein b was from about 5 to about 2000 and d was from about 5 to about 2000, about 0.2 kg of DOWFAX™ 2A1, an alkyldiphenyloxide disulfonate available commercially from The Dow Chemical Company, about 9.4 kg of two magenta pigments, PR122 and PR269 (at a ratio of about 50:50) in a dispersion, and about 3.4 kg of a polyethylene wax (from IGI) in a dispersion. The components were mixed and then pH adjusted to 4.2 using 0.3M nitric acid.

The slurry was homogenized for about 10 minutes at from about 3000 revolutions per minute (rpm) to about 4000 rpm while adding about 0.197 kg of aluminum sulfate as a coagulant. The toner slurry aggregated at a temperature of around 43° C. During aggregation, the toner particle size was closely monitored. At around 4.8 microns in size, a shell including the same amorphous emulsion (ratio 50:50) as in the core was added to achieve the final targeted particle size of about 5.3 microns. The pH of the slurry was adjusted to about 7.8 using sodium hydroxide (NaOH) and VERSENE-100 (EDTA) from the Dow Chemical Company to freeze, i.e. stop, the aggregation step.

The process proceeded with the reactor temperature (Tr) increased to achieve 85° C. while maintaining a pH≥about 7.8 until Tr was about 85° C. Once the Tr reached 85° C., the pH of the toner slurry was reduced to 6.3 with the addition of pH 5.7 sodium acetate buffer and held until the circularity reached ≥about 0.965.

The particles were then washed 7 times with deionized water (DIW), and pressed by a LAROX filter press to form a wet cake. The final wet cake, having a moisture content of about 22% by weight, had a yield of about 14 kg and was split into 2 portions for drying. Drying was carried out by a flash drying system known as an Aljet Thermajet dryer Model 4, commercially available from Fluid Energy Processing and Equipment company. One portion was treated with Cabot TS-530 colloidal silica, having a particle size less than about 10 nm (from Cabot Corporation), while the other portion was untreated and utilized as a control. Table 1 below provides the process conditions and results obtained for each portion.

TABLE 1

| | Magenta toner | |
|---|---|---|
| Processing Condition | Without silica (CONTROL) | With 0.5% silica |
| Temp in-Temp out (for drying) | 73-44° C. | 73-44° C. |
| Time required for drying | 127 minutes | 102 minutes |
| Amount of toner wet cake added | 7 kg @ 22.7% moisture | 7 kg @ 22.2% moisture |
| Silica added | 0 | 27.2 grams |

As can be seen from Table 1 above, there was a 19.7% decrease in cycle time for drying (from 127 minutes to 102 minutes) with the addition of the silica flow aid.

Example 2

Two 20 gallon batches of black emulsion aggregation toners were made. The emulsion aggregation toners were produced as described in Example 1 above, except about 6 kg of Nippex-35 black pigment and 1 kg of a cyan pigment, Pigment Blue 15:3 (PB15:3) was added thereto. One toner was not treated (Control Black) and the other was treated with Cabot TS-530 colloidal silica, having a particle size less than about 10 nm (from Cabot Corporation) (Example 2 Black). Each of the two batches were washed and then pressed into wet cakes. The dryer utilized was a flash drying system known as an Aljet Thermajet dryer Model 4 (commercially available from Fluid Energy Processing and Equipment company) for black toner that was purged between batches. Thus, the same level of clean was seen before each toner was individually dried. Results and process conditions can be seen in the table below for each toner.

TABLE 2

| Processing Condition | Control Black Without silica | Example 2 Black With 0.5% silica |
|---|---|---|
| Amount of toner wet cake added | 16.4 kg @ 31% moisture | 15.7 kg @ 31% moisture |
| Silica added | 0 | 55 grams |
| Temp in-Temp out (for drying) | 73-46° C. | 73-46° C. |
| Cycle Time required for drying (minutes) | 145 | 117 |
| Theoretical Yield | 11.3 kg | 10.8 kg |
| Actual Yield | 8.9 kg | 11.8 kg |
| Toner Yield During Drying | 79% | >99% |

Due to the poor flow of the toner particles in the control Black 1, there was a 21% loss of yield. To the contrary, the Example 2 Black toner, with silica, had no loss of yield; in fact, the toner particles that were adhered to the dryer that remained after cleaning were probably dislodged from a prior batch, thus increasing the yield above 100%. As can be seen from the above, without the flow aid, at least about 21% of the toner was lost during drying due to poor flow and adhesion to the dryer.

It can also be seen from the above Table 2 that there was a 19.3% decrease in cycle time for drying (from about 145 minutes to about 117 minutes) with the addition of the silica flow aid.

Charging and fusing characteristics of both the magenta and black control toners and the magenta toner of Example 1 and the black toner of Example 2 are set forth in FIGS. 1-4. Charging data was obtained by using a charge spectrograph operating with a perpendicular electric field of 100 V/cm and a column length of 30 cm. The charge was measured as the average displacement in mm of the toner from a zero charge spot. The toner charge can also be expressed in units of femto coulombs per micron by multiplying the displacement in mm by the factor of 0.092

Figure 2:
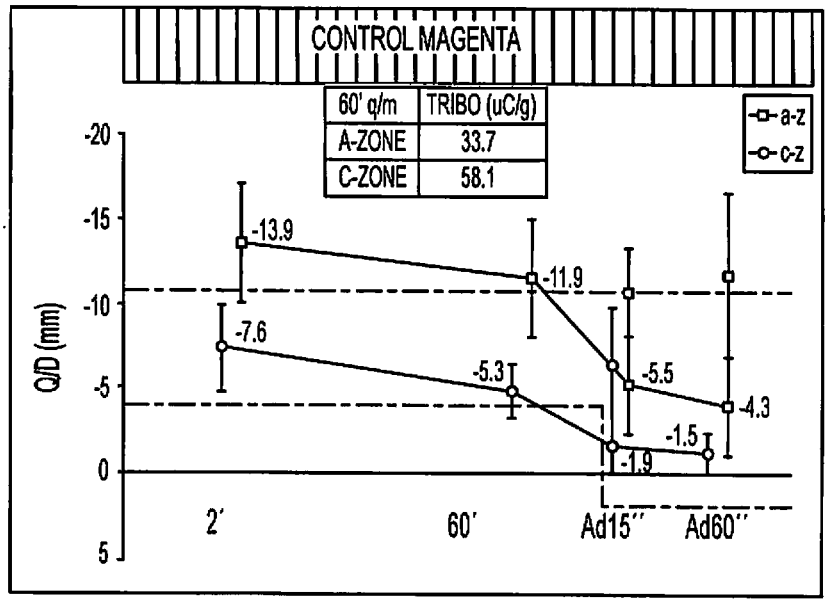
FIG. 2 is a graph depicting triboelectric charge of a toner lacking the silica treatment of the present disclosure.
Figure 3:
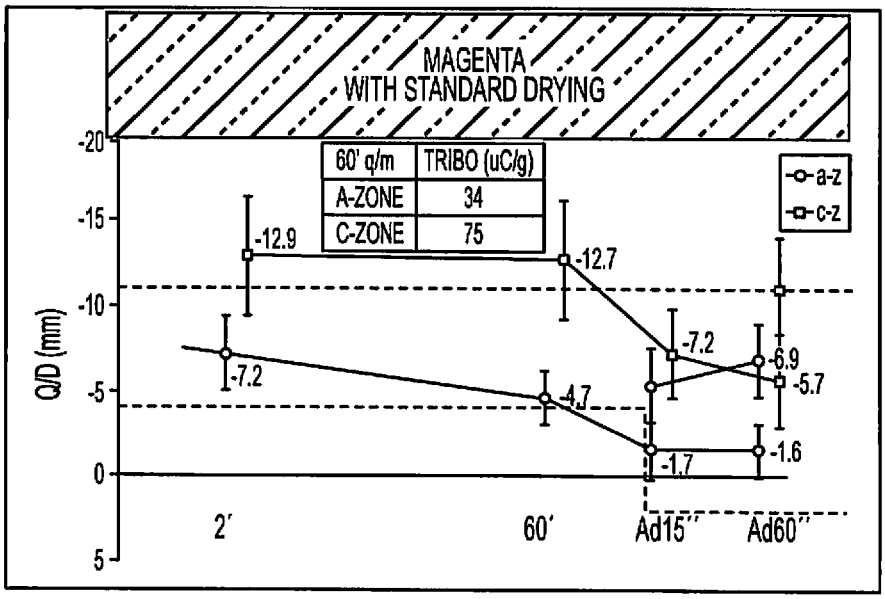
FIG. 3 is a graph depicting triboelectric charge of a toner lacking the silica treatment of the present disclosure.
Figure 4:
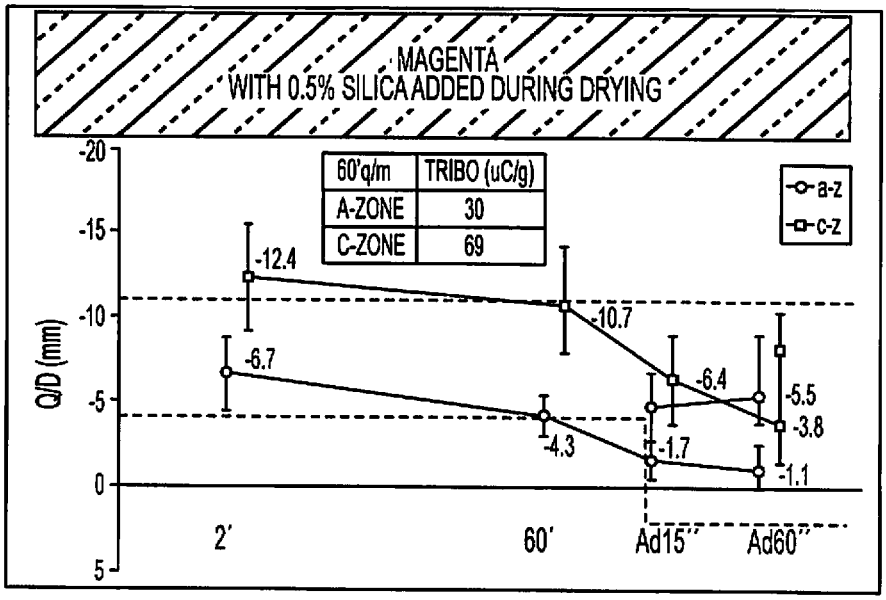
FIG. 4 is a graph depicting triboelectric charge of a toner of the present disclosure that has been subjected to a silica treatment and then dried.

Toners of the present disclosure may also possess a parent toner charge per mass ratio (Q/m). Toner q/m was obtained from a triboelectric charge blow-off measurement apparatus. Fusing data was obtained. FIG. 1 is a graph depicting parent charge of a toner produced in accordance with the present disclosure, with silica added to the wet cake prior to drying, compared with a control toner lacking the silica treatment. FIG. 2 is a graph depicting triboelectric charge of a toner lacking the silica treatment of the present disclosure. FIG. 3 is a graph depicting triboelectric charge of a core shell toner lacking the silica treatment of the present disclosure. FIG. 4 is a graph depicting triboelectric charge of a toner of the present disclosure that has been subjected to a silica treatment and then dried.

Example 3

An additive package was added to the magenta toner particles of Example 1 and the blocking and cohesion flow was determined by a Hosokawa Micron Flow Tester. The additive package included the following:

1. about 1.40% by weight of a silica surface treated with polydimethylsiloxane, commercially available as RY50L from Evonik (Nippon Aerosil);
2. about 0.94% by weight of a silica surface treated with hexamethyldisilazane, commercially available as RX50 from Evonik (Nippon Aerosil);
3. about 0.96% by weight of a titanium surface treated with butyltrimethoxysiliane, commercially available as STT100H available from Titan Koygo;
4. about 1.89% by weight of a sol-gel silica surface treated with hexamethyldisilazane, commercially available as X24-9163A from Nisshin Chemical Kogyo;
5. about 0.31% by weight of a cerium dioxide, commercially available as E10 from Mitsui Mining & Smelting;
6. about 0.20% by weight of a zinc stearate, commercially available as ZnFP from NOF; and
7. about 0.55% by weight of PMMA polymer particles, commercially available as MP116CF from Soken.

The results of the Heat Cohesion and Cohesion Flow testing are set forth below in Table 3 below.

TABLE 3

| | Cohesion (Flow) <10 | | Heat Cohesion <10 |
|---|---|---|---|
| Toner Treatment | Parent | Additives | 53° C./50% RH |
| Standard Drying | 93 | 26.5 | 10 |
| 0.5% Silica Added During Drying | 9.5 | 14 | 9 |

As can be seen from the above, the Parent cohesion (flow) improved by a factor of ten as compared with standard drying. The overall flow improvement was also seen after the standard additive package was added. This improved flow can help reduce toner clumping and caking in shipping, the machine bottles etc.

Fusing

The magenta toners of Example 1 and the magenta control, lacking the silica treatment, were submitted for fusing evaluation. Fusing performance (gloss, crease, and hot offset measurements) of particles was collected.

All unfused images were generated using a modified DC12 copier from Xerox Corporation. A TMA (Toner Mass per unit Area) of 1.00 mg/cm$^2$ of each toner was made on Color Xpressions+ paper (90 gsm, uncoated) (sometimes referred to as CX+ paper), using a commercially available fusing fixture. Gloss/crease targets were a square image placed in the center of the page.

Process speed of the fuser was set to 220 mm/second (nip dwell of about 34 miliseconds) and the fuser roll temperature was varied from cold offset to hot offset or up to about 210° C. for gloss and crease measurements.

Crease area measurements were carried out with an image analysis system. Print gloss as a function of fuser roll temperature was measured with a BYK Gardner 75° gloss meter. A summary of the fusing results is reported in Table 4 below. Gloss at 185° C., fusing latitude, and the minimum fusing temperature (MFT) is reported.

TABLE 4

| | Magenta | Magenta + silica |
|---|---|---|
| Cold offset on CX+ | 130 | 130 |
| Gloss at MFT on CX+ | 24.0 | 25.6 |
| Gloss at 185° C. on CX+ | 72.5 | 71.9 |
| Peak Gloss on CX+ | 73.6 | 73.4 |
| T (Gloss 50) on CX+ | 154 | 154 |
| T (Gloss 60) on CX+ | 164 | 164 |
| $MFT_{CA-80}$ (extrapolated MFT) | 132 | 134 |
| ΔMFT (EA/SA-40° C.) (relative to a conventional EA toner using the same resins fused the same day) | −19 | −17 |
| Mottle/Hot Offset CX+220 mm/s | >320/>210 | <210/<210 |
| Fusing Latitude HO-MFT on DCX+ (>50) | >78 | >78 |
| ΔFix ($T_{G50}$ & $MFT_{CA-80}$) | −13 | −13 |
| 24 hour @ 60° C. Document Offset Toner-Toner/Toner-Paper (rmsLA % voide) | 4.50/1.50 0.018/0.68% | 4.50/1.75 0.003/0.42% |
| 7 Day @ 60° C. Document Offset (>G4) Toner-Toner/Toner-Paper | N/A | N/A |
| Vinyl Offset (G4.5) FX Vinyl | N/A | N/A |

CX+ = paper utilized from Xerox Corporation

MFT = minimum fusing temperature

Fusing Latitude = Hot Offset-MFT on CX+ paper

Δfix is the minimum fusing temperature required to reach 50 gloss units or a crease fix area of 80 relative to some control toner.

24-hour @ 60° C. Document Offset Toner = amount of Toner to toner and toner to paper document offset test conducted at 60° C./80 g/cm$^2$/50% R.H.

ΔMFT(EA/SA-40° C.) = minimum fixing temperature in reference to a styrene-acrylate emulsion aggregation type toner Mottle/Hot Offset = the temperature at which the toner will lift off the paper and stick to the fuser roll As seen from the data of Tables 3 and 4 above, neither charging nor fusing showed significant difference due to the presence of silica. In fact, the parent toner heat cohesion improved with the addition of 0.5% silica.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A process for preparing toner particles comprising:

contacting at least one amorphous resin with at least one crystalline resin in a mixture;

aggregating the mixture to form particles;

coalescing the particles to form toner particles;

washing the toner particles to form a wet cake of toner particles;

contacting the wet cake with at least one flow aid comprising a hydrophobic metal oxide, the flow aid configured for any of;

a) reducing overall drying cycle time;

b) reducing amount of coarse particles in the toner;

c) increasing yield of the toner particles;

d) improving cohesion of the toner, or e) any combination thereof;

drying the wet cake; and recovering the toner particles, wherein the toner particles possess the hydrophobic metal oxide in amounts of from about 5 ppm to about 20,000 ppm.

2. The process of claim 1, wherein the at least one amorphous polyester resin comprises an alkoxylated bisphenol A fumarate/terephthalate based polyester or copolyester resin, and wherein the at least one crystalline resin comprises (II)

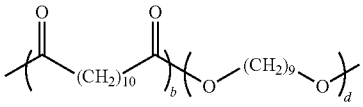

wherein b is from about 5 to about 2000 and d is from about 5 to about 2000.

3. The process of claim 1, wherein aggregating the mixture occurs at a temperature of from about 40° C. to about 100° C., for a time of from about 0.5 hours to about 6 hours.

4. The process of claim 1, wherein coalescing the particles occurs at a temperature of from about 45° C. to about 100° C. over a period of time from about 0.01 to about 9 hours.

5. The process of claim 1, wherein the hydrophobic metal oxide comprises an oxide of a metal selected from the group consisting of silicon, titanium, nickel, zirconium, silver, chromium, aluminum, cerium, zinc, strontium, beryllium, and combinations thereof.

6. The process of claim 1, wherein the hydrophobic metal oxide comprises particles having a size of from about 5 nm to about 50 nm.

7. The process of claim 1, wherein the hydrophobic metal oxide comprises particles having a size of from about 20 nm to about 30 nm.

8. The process of claim 1, wherein the hydrophobic metal oxide is added to the wet cake in amounts of from about 0.01% to about 5% of the weight of the toner particles.

9. The process of claim 1, wherein the hydrophobic metal oxide is added to the wet cake in amounts of from about 0.1% to about 2% of the weight of the toner particles.

10. The process of claim 1, wherein the cohesion of the parent toner is from about 0% to about 20%.

11. A process for preparing toner particles comprising:

contacting at least one amorphous resin with at least one crystalline resin in a mixture;

aggregating the mixture to form particles;

coalescing the particles to form toner particles;

washing the toner particles to form a wet cake of toner particles;

contacting the wet cake with at least one flow aid comprising a hydrophobic metal oxide comprising an oxide of a metal selected from the group consisting of silicon, titanium, nickel, zirconium, silver, chromium, aluminum, cerium, zinc, strontium, beryllium, and combinations thereof, the flow aid configured for any of;

a) reducing overall drying cycle time;

b) reducing amount of coarse particles in the toner;

c) increasing yield of the toner particles;

d) improving, cohesion of the toner, or e) any combination thereof;

drying the wet cake; and recovering the toner particles, wherein the toner particles possess the hydrophobic metal oxide in amounts of from about 5 ppm to about 20,000 ppm.

12. The process of claim 11, wherein the at least one amorphous polyester resin comprises an alkoxylated bisphenol A fumarate/terephthalate based polyester or copolyester resin, and wherein the at least one crystalline resin comprises (II)

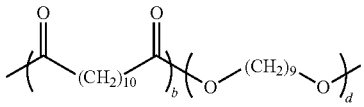

wherein b is from about 5 to about 2000 and d is from about 5 to about 2000.

13. The process of claim 11, wherein aggregating the mixture occurs at a temperature of from about 40° C. to about 100° C., for a time of from about 0.5 hours to about 6 hours.

14. The process of claim 11, wherein the hydrophobic metal oxide comprises particles having a size of from about 5 nm to about 50 nm, and wherein the hydrophobic metal oxide is added to the wet cake in amounts of from about 0.01% to about 5% of the weight of the toner particles.

15. The process of claim 11, wherein the hydrophobic metal oxide comprises particles having a size of from about from about 20 nm to about 30 nm, added to the wet cake in amounts of from about 0.1 to about 2% of the weight of the toner particles.

16. The process of claim 11, wherein the heat cohesion of the parent toner is from about 0% to about 20%.

17. A process for preparing toner particles comprising:

contacting at least one amorphous resin with at least one crystalline resin in a mixture;

aggregating the mixture to form particles at a temperature of from about 40° C. to about 100° C., for a time of from about 0.5 hours to about 6 hours;

coalescing the particles to form toner particles at a temperature of from about 45° C. to about 100° C., over a period of time from about 0.01 to about 9 hours;

washing the toner particles to form a wet cake of toner particles;

contacting the wet cake with at least one flow aid comprising hydrophobic silica particles having a size of from about 5 nm to about 50 nm, the flow aid configured for any of;

a) reducing overall drying cycle time;

b) reducing amount of coarse particles in the toner;

c) increasing yield of the toner particles;

d) improving cohesion of the toner, or e) any combination thereof;

drying the wet cake; and recovering the toner particles, wherein the toner particles possess the hydrophobic silica in amounts of from about 5 ppm to about 20,000 ppm.

18. The process of claim 17, wherein the at least one amorphous polyester resin comprises an alkoxylated bisphenol A fumarate/terephthalate based polyester or copolyester resin, and wherein the at least one crystalline resin comprises (II)

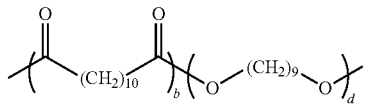

wherein b is from about 5 to about 2000 and d is from about 5 to about 2000.

19. The process of claim 17, wherein the hydrophobic silica is added to the wet cake in amounts of from about 0.01% to about 5% of the toner particles.

20. The process of claim 17, wherein the cohesion of the parent toner is from about 0% to about 20%.

* * * * *